US006471364B1

(12) United States Patent
Plante

(10) Patent No.: US 6,471,364 B1
(45) Date of Patent: Oct. 29, 2002

(54) CHEMILUMINESCENT LOLLYPOP

(76) Inventor: Jon M. Plante, 9333 Buck Haven Ter., Tallahassee, FL (US) 32312

( * ) Notice: Subject to any disclaimer, the term of this patent is extended or adjusted under 35 U.S.C. 154(b) by 0 days.

(21) Appl. No.: 09/810,804

(22) Filed: Mar. 19, 2001

(51) Int. Cl.[7] ..... F21K 2/06
(52) U.S. Cl. ..... 362/34; 362/84; 40/442
(58) Field of Search ..... 362/34, 109, 84, 362/253; 40/442, 443; 446/84, 267

(56) References Cited

U.S. PATENT DOCUMENTS 5,921,841 A * 7/1999 Coleman et al. ..... 426/104
6,077,144 A * 6/2000 Fishman ..... 40/442
6,135,606 A * 10/2000 Fernandez et al. ..... 362/109

* cited by examiner

*Primary Examiner*—Sandra O'Shea
*Assistant Examiner*—Hargobind S. Sawhney
(74) *Attorney, Agent, or Firm*—John Wiley Horton

(57) ABSTRACT

A lollypop having an internally illuminated stem to form a pleasing visual effect. A chemiluminescent cylinder is used as the stem. One end of the stem is exposed for gripping by the user. The other is embedded in the center of the lollypop—which is made of hard translucent candy. The lollypop, including the chemiluminescent stem, is packaged as one disposable unit. When the user wishes to consume the candy, the user removes the unit from its packaging. The user then bends the exposed portion of the stem which fractures an internal chemical separation barrier within the stem. The user then shakes the unit, which mixes the two chemicals within the stem and produces the chemiluminescence. This results in the entire stem giving off a soft light, including the portion embedded within the translucent candy.

3 Claims, 5 Drawing Sheets

CHEMILUMINESCENT LOLLYPOP

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to novelties and particularly to the field of candy. More specifically, the invention comprises a lollypop having a chemiluminescent stem which provides internal illumination in order to produce a novel and amusing effect.

2. Description of the Related Art

There are numerous prior art novelty devices relating to the filed of candy. One such device is disclosed in U.S. Pat. No. 4,914,748 to Schlotter et.al (1990). The '748 device essentially comprises a modified flashlight with a stem on its illuminated end designed to hold a piece of candy. The flashlight directs a beam of light into the candy, which is preferably translucent in nature. Once the candy is consumed, the device may be cleaned and a new piece of candy can be placed on the stem. One variant disclosed is intended to be discarded once the batteries have been consumed. A second variant allows for the replacement of the batteries so that the device can be used over an extended period.

Another candy-related novelty device is disclosed in U.S. Pat. No. 5,471,373 to Coleman et.al. (1995). The '373 device is a candy sucker holder. The holder includes batteries, an integrated circuit providing control, and a plurality of LED's directed up toward the candy sucker. The integrated circuit can produce a variety of noises or music. It synchronizes the noises or music with pulses of the LED's. These LED's flash light onto the candy sucker, thereby providing amusement. The device holds the candy sucker (lollypop) by its stem. Once the sucker has been consumed, the user discards the stem. A new candy sucker can then be placed in the device.

A third candy-related novelty device is shown in U.S. Pat. No. 6,135,606 to Fernandez et.al. (2000). The Fernandez device is similar to the Schlotter device disclosed earlier. It features a grip portion and a stem portion extending therefrom which is intended to hold a candy sucker. The grip portion contains batteries and control circuitry. LED's are positioned at the base of the stem portion. These shine light up into the stem, where it radiates into the candy sucker. The stem—which is hollow—also features a random bundle of optical fibers which diffuse the light in an interesting pattern.

All three prior art devices employ battery-powered illumination. This greatly increases the cost of the device and restricts its appeal as a disposable object (owing to both cost and environmental concerns). The devices have additional drawbacks in that they:

1. Must be cleaned to be reused with another candy sucker;

2. Are bulky in comparison to the candy sucker; and
3. Are complex.

BRIEF SUMMARY OF THE INVENTION

The present invention comprises a modification to the traditional lollypop. A chemiluminescent cylinder is used as the stem of the lollypop. One end of the stem is exposed for gripping by the user. The other is embedded in the center of the lollypop—which is made of hard translucent candy. The lollypop, including the chemiluminescent stem, is packaged as one disposable unit. When the user wishes to consume the candy, the user removes the unit from its packaging. The user then bends the exposed portion of the stem, which fractures an internal chemical separation barrier within the stem. The user then shakes the unit, which mixes the two chemicals within the stem and produces the chemiluminescence. This results in the entire stem giving off a soft light, including the portion embedded within the translucent candy.

A second embodiment covers the exposed portion of the stem with a reflective foil. This foil to internally reflect the light and only allows it to escape within the translucent candy, producing a different type of visual effect.

The objects and advantages of the present invention are to provide an internally illuminated lollypop which:

1. Is inexpensive;
2. Is disposable after a single use; and
3. Is non-toxic.

REFERENCE NUMERALS IN THE DRAWINGS

| | | | |
|---|---|---|---|
| 10 | candy | 12 | hole |
| 14 | stem | 16 | flexible housing |
| 18 | frangible vial | 20 | first chemical |
| 22 | second chemical | 24 | end seal |
| 26 | foil | 28 | hollow interior |

DETAILED DESCRIPTION OF THE INVENTION

Figure 1:
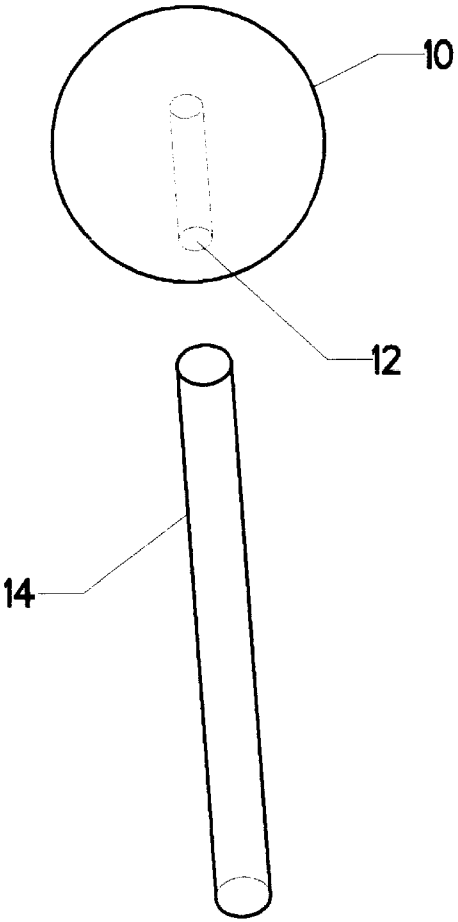
FIG. 1 is an isometric view, showing the proposed invention.

FIG. 1 shows the invention in a disassembled state. Candy 10 is a spherical piece of translucent material, such as the hard candy commonly used in lollipops. While it has been illustrated as a sphere, it could be formed in any desired shape. The lower surface of candy 10 opens into hole 12. In the particular embodiment shown, hole 12 is a cylindrical cavity.

Stem 14 is formed in the shape of an elongated cylinder. Its upper portion fits within hole 12. The invention contemplates that candy 12 and stem 14 will be bonded together.

Thus, the upper portion of stem 14 must be bonded to the cylindrical wall of hole 12. This bonding may be accomplished in a number of conventional ways. One approach would be to manufacture candy 10 and stem 14 separately, and then use a sugar-based adhesive to adhere the upper portion of stem 14 within hole 12. Another approach would be to form candy 10 around the upper portion of stem 14 while it is still in the liquid state (a molding process). Most hard candies will adhere well to a surface they contact while still in the liquid state. As the bonding method employed is not significant to the invention, any suitable method could be selected.

Figure 2:
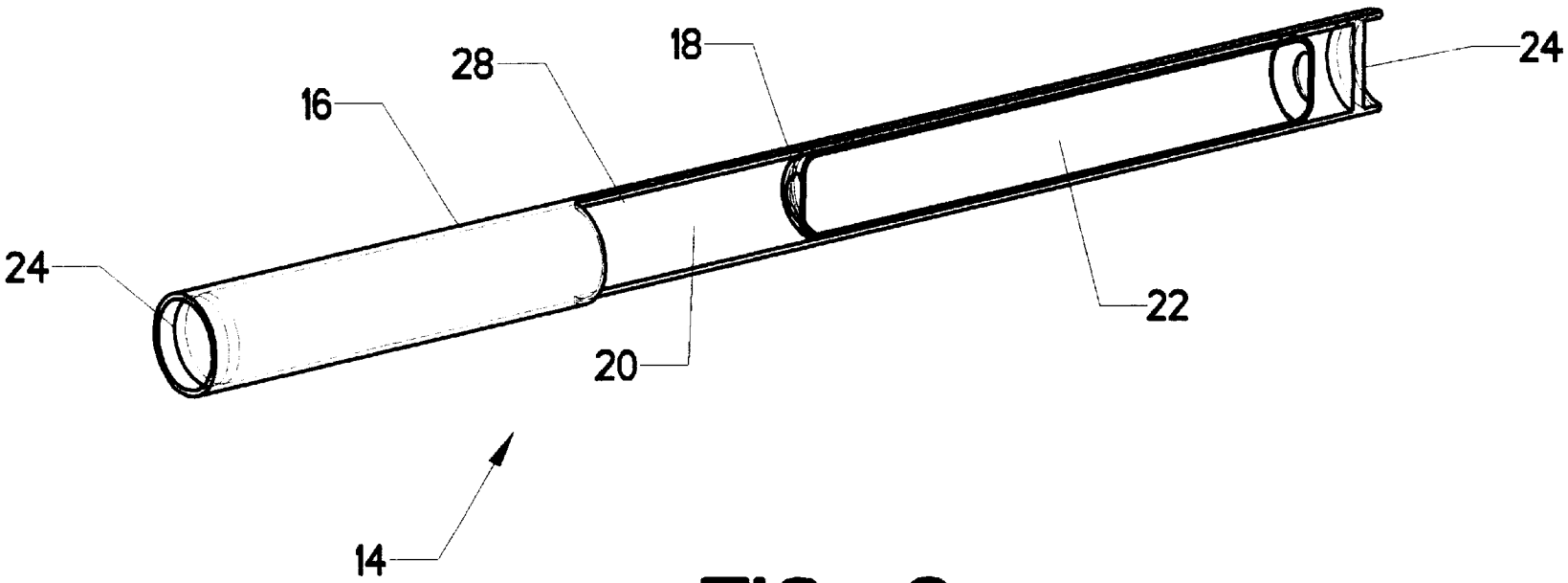
FIG. 2 is an isometric view with a cutaway, showing the internal construction of the stem.

FIG. 2 illustrates the internal details of stem 14. The reader will observe that stem 14 is formed by a hollow and cylindrical flexible housing 16. Flexible housing 16 is sealed at both ends by end seals 24 to form hollow interior 28. A cutaway is provided to allow an understanding of the internal details of stem 14. Inside hollow interior 28 is frangible enclosure 18. As illustrated, frangible enclosure 18 is typically a second smaller cylinder closely fitted within hollow interior 28. This arrangement results in hollow interior 28 being divided into two separate compartments. The first compartment contains fist chemical 20. The second compartment—being within frangible enclosure 18—contains second chemical 22.

First chemical 20 and second chemical 22 are selected for their property of forming a chemiluminescent reaction when combined. As shown in FIG. 2, the two chemicals are completely separated and inert. However, if the user grasps stem 14 and bends flexible housing 16, frangible enclosure 18 will break, thereby allowing the two chemicals to mix and initiate the chemiluminescent reaction. The result is that stem 14 will become internally illuminated.

Those skilled in the art will appreciate that the selection of materials for stem 14 is important. Flexible housing 16 must be a non-toxic material, since it will be placed in the user's mouth. It must also be capable of bending sufficiently to allow the fracture of frangible enclosure 18, yet still be tough enough to prevent leaks. The reactive chemicals selected must produce a low temperature reaction. The resulting products, as well as the initially separate chemicals, must be non-toxic in the event of a leak. These requirements are presently met by the light sticks manufactured by American Cyanamid Company, Wayne, NJ, which are sold under the trade name CYALUME.

Figure 3:
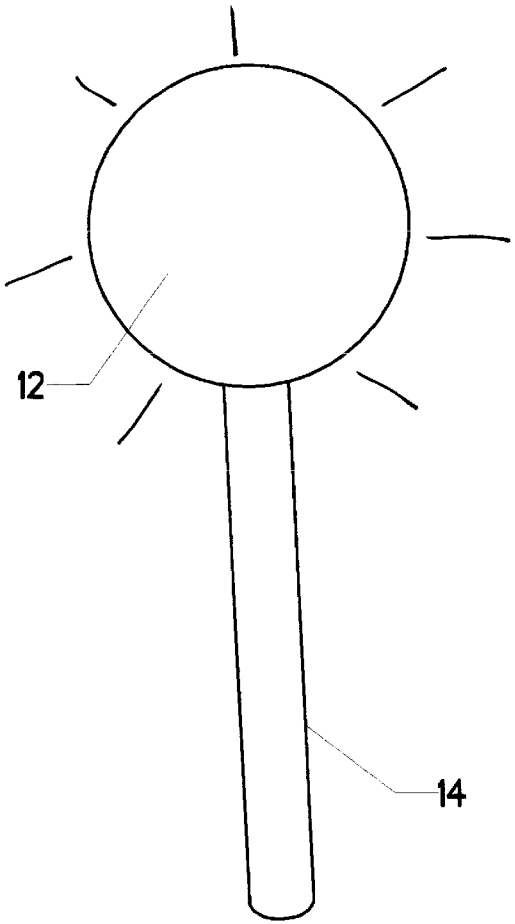
FIG. 3 is an isometric view, showing the radiation of light from the invention.

FIG. 3 shows the assembled invention, with stem 14 and candy 10 bonded together. The reader will note that the upper portion of stem 14 is embedded within candy 10. The reader will also note that the lower portion of stem 14 extends downward far enough to provide a grip for the user. The user grasps the invention by this portion and places candy 10 in his or her mouth. The radiating lines shown in FIG. 3 represent the light radiating from the device once the chemiluminescent properties of stem 14 have been activated as described previously. The result is a novel and pleasing visual effect.

Figure 4:
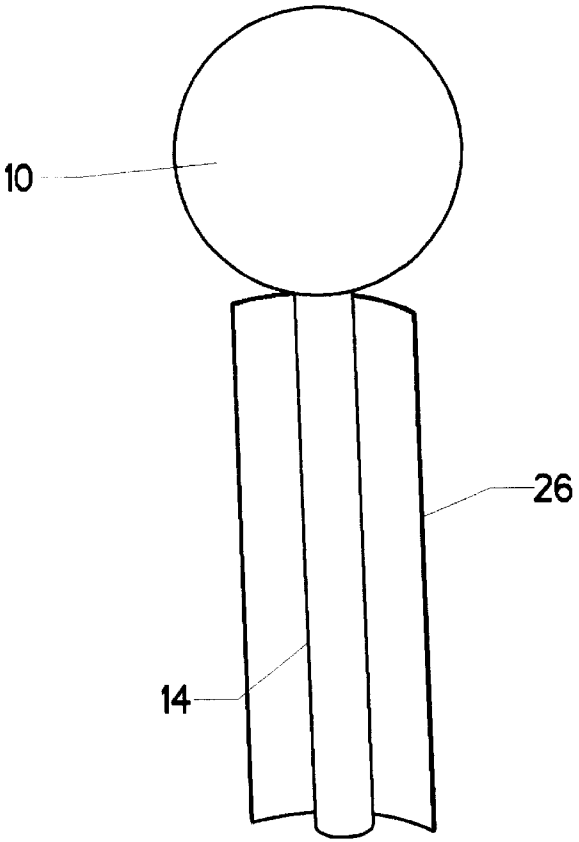
FIG. 4 is an isometric view, showing an alternate embodiment of the invention.

FIGS. 1 through 3 represent the simplest version of the invention and are therefore the preferred embodiment. FIG. 4 illustrates an additional embodiment which produces a different visual effect. Foil 26 is wrapped around the lower (exposed) portion of stem 14 as shown. Foil 26 preferably has a pressure-sensitive adhesive on its interior surface so that it adheres to stem 14 without the need for an added adhesive. Foil 26 is an opaque material, preferably having a reflective coating on its interior surface so as to reflect any light generated by stem 14 back toward stem 14.

Figure 5:
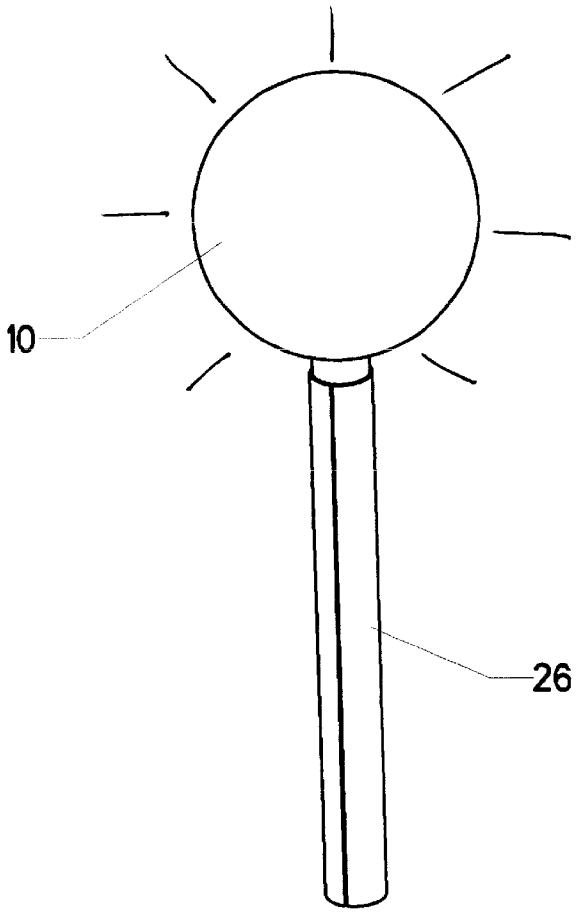
FIG. 5 is an isometric view, showing the alternate embodiment in operation.

FIG. 5 shows foil 26 in place on stem 14. Foil 26 prevents light from escaping through the lower portion of stem 14. The reflective coating on its interior surface reflects the light within stem 14 so that it can only escape through the upper portion of stem 14, which is embedded within candy 10. The result is that more light is emitted within candy 10 and no light is emitted by the lower portion of stem 14. The radiating lines in FIG. 5 depict this emitted light. One can also optionally cover the bottom surface of stem 14 in order to prevent light escaping out the bottom.

Accordingly, the reader will appreciate that the proposed invention can create a novel and visually pleasing effect. The invention has further advantages in that it:

1. Is inexpensive;
2. Is disposable after a single use; and
3. Is non-toxic.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. An internally illuminated lollypop for the amusement of a user, comprising:

a. a piece of candy, being formed in any desired shape, and having an upper portion and a lower portion, wherein said lower portion opens into a hole;

b. an elongated hollow stem, with said hollow stem being sealed on both ends to form an enclosed hollow interior, wherein said stem has an upper portion and a lower portion, wherein said upper portion is positioned within said hole, and wherein said lower portion extends downward from said piece far enough to provide a grip for said user;

c. means for bonding said upper portion of said stem to said piece;

d. a first reactive chemical contained within said hollow interior of said stem; and e. a second reactive chemical, contained within said hollow interior of said stem, but completely separated from said first reactive chemical by a frangible barrier, so that said first and second reactive chemicals do not come into contact until said user flexes said stem, thereby breaking said frangible barrier, allowing said first and said second reactive chemicals to mix and form a chemiluminescent reaction, thereby giving off light and internally illuminating said stem.

2. The device as recited in claim 1, wherein said lower portion of said stem is covered by an opaque film.

3. The device as recited in claim 2, wherein said opaque film has an inside surface and an outside surface, and wherein said inside surface is reflective.

* * * * *